United States Patent [19]

Streibel

[11] Patent Number: 4,589,159

[45] Date of Patent: May 20, 1986

[54] TOOTHBRUSH

[76] Inventor: Adolf Streibel, Günderodestr. 6, D-8000 München 83, Fed. Rep. of Germany

[21] Appl. No.: 566,210

[22] Filed: Dec. 28, 1983

[30] Foreign Application Priority Data

Dec. 29, 1982 [DE] Fed. Rep. of Germany ..... 3248527

[51] Int. Cl.[4] ..... A46B 9/04

[52] U.S. Cl. ..... 15/167 R; 15/143 R; 40/314; D4/107; 248/110; 211/66

[58] Field of Search ..... D4/14–31, D4/107; 40/314; 15/167 R, 105, 143 R; D7/143–146; 248/110–112; 211/66

[56] References Cited

U.S. PATENT DOCUMENTS

| | | | |
|---|---|---|---|
| D. 3,302 | 12/1868 | Reed | D7/145 |
| D. 21,054 | 9/1891 | Kaiser | D7/145 |
| D. 21,868 | 9/1892 | Richards | D7/143 |
| D. 38,745 | 8/1907 | Edmonston | D7/144 |
| D. 47,740 | 8/1915 | Schwinn | D7/144 |
| D. 63,608 | 12/1923 | Bevans | D4/26 |
| D. 71,286 | 10/1926 | Lord | D4/107 |
| D. 92,616 | 6/1934 | Largever | D4/107 |
| D. 110,186 | 6/1938 | Lukenbill | D4/25 |
| D. 123,388 | 11/1940 | Duey | D4/25 |
| D. 145,339 | 7/1946 | Stokby | D7/143 |
| D. 154,757 | 8/1949 | Fishman | D7/143 |
| D. 167,300 | 7/1952 | Brooks | D7/144 |
| D. 190,343 | 5/1961 | Zuckerman | D7/145 |
| D. 191,096 | 8/1961 | Gordon et al. | D4/18 |
| D. 229,903 | 1/1974 | Ceniceros | D4/107 |
| D. 246,878 | 1/1978 | Kitzis | D4/18 |
| 876,317 | 1/1908 | Booth | D4/25 X |
| 1,222,377 | 4/1917 | Flint | 40/314 |
| 1,506,401 | 8/1924 | Young | 15/167 R X |
| 1,758,632 | 5/1930 | Wagner | D4/18 |

FOREIGN PATENT DOCUMENTS 351159 6/1931 United Kingdom .

OTHER PUBLICATIONS

American Pewter Co.; Apr. 1974, pp. 37 and 38, Gifts and Decorative Accessories.

Smithsonian Publication, Jun., 1980, p. 21.

*Primary Examiner*—Peter Feldman

*Attorney, Agent, or Firm*—Peter K. Kontler

[57] ABSTRACT

A toothbrush whose handle is provided with a disc-shaped or otherwise configurated indicia-bearing member extending laterally beyond one or both marginal portions of the handle. The indicia-bearing member can constitute that end portion of the handle which is remote from the bristles, such member can be adjacent to this end portion, or such member can be nearer to the bristles than to this end portion of the handle. One or more hooks and sockets can be provided on the indicia-bearing member to facilitate suspension of the toothbrush in such orientation that the bristles are located at the upper or lower end of the handle. The indicia-bearing member is formed with a flat, concave or convex surface which carries one or more indicia-bearing labels and is surrounded by a raised border.

10 Claims, 4 Drawing Figures

TOOTHBRUSH

BACKGROUND OF THE INVENTION

The present invention relates to toothbrushes in general, and more particularly to improvements in toothbrushes of the type having surfaces for reception of indicia.

British Pat. No. 351,159 discloses a toothbrush whose handle bears indicia on surfaces which are recessed into the handle or which are partitioned off from the remaining portion of the handle. A drawback of such toothbrushes is that the indicia and the indicia-bearing surface or surfaces do not extend laterally beyond the handle. Thus, and since the handle of a toothbrush is a relatively narrow elongated body, the indicia are necessarily small. Therefore, such indicia do not readily hit the eye and cannot be used as an effective means for facilitating rapid and reliable recognition of a particular toothbrush among additional toothbrushes. Moreover, the just discussed conventional brushes cannot be readily suspended, either in the store or in the home of the user, except if they are provided with holes in those end portions of the handles which are remote from the bristles.

German Utility Model No. 19 93 022 discloses a modified toothbrush whose handle has an enlarged end portion which is remote from the brushes and supports a mirror. The latter resembles the mirror on a dentist's implement and serves an analogous purpose, especially to enable the user to observe the inner sides of his or her teeth. The toothbrush of this Utility Model does not bear any indicia, especially none of the type which would be capable of readily distinguishing a particular toothbrush from other toothbrushes in a store (e.g., a drugstore) or at home where the rack for toothbrushes or a cup for toothbrushes is likely to contain a reasonable or even large number of toothbrushes belonging to different members of the family.

OBJECTS AND SUMMARY OF THE INVENTION

An object of the invention is to provide a novel and improved toothbrush which is constructed and configurated in such a way that it is readily distinguishable from other toothbrushes.

Another object of the invention is to provide a toothbrush which can be readily recognized by its owner even if it is one of an array of a reasonable or substantial number of toothbrushes.

A further object of the invention is to provide a toothbrush which can be readily exhibited in a store or at home in such a way that its owner or a prospective purchaser is likely to detect it without much searching and without resorting to spectacles.

An additional object of the invention is to provide a toothbrush which, in addition to being readily recognizable or distinguishable, is also capable of being prominently exhibited in a store or in a bathroom.

Still another object of the invention is to provide a novel and improved handle for a toothbrush.

A further object of the invention is to provide a toothbrush which exhibits the above-outlined features but can be mass-produced at a cost not exceeding the cost of a conventional toothbrush.

An additional object of the invention is to provide a novel and improved method of identifying toothbrushes.

The invention is embodied in a toothbrush which comprises a handle including an end portion and an elongated second portion having a pair of longitudinally extending marginal portions, bristles which are anchored in and extend from the end portion of the handle, and an indicia-bearing member which is provided on the second portion of the handle and extends laterally beyond at least one of the marginal portions, preferably beyond both marginal portions. The indicia-bearing member is preferably provided with a flat, convex or concave surface which is preferably surrounded by a raised border, and such member can constitute or resemble a disc having a circular, oval or polygonal outline. The indicia can be borne by a label which adheres to the surface of the indicia-bearing member.

The second portion of the handle includes a second end portion, and the indicia-bearing member can constitute such second end portion or it may be adjacent thereto. Alternatively, the indicia-bearing member can be remote from the second end portion so that it is nearer to the bristles than to the second end portion.

The indicia-bearing member can further comprise one or more hooks and sockets and/or otherwise configurated suspension facilitating means. Such suspension facilitating means can face toward or away from the bristles, depending upon the distance between the bristles and the indicia-bearing member. At the present time, it is preferred to make the indicia-bearing member an integral part of the handle. In lieu of or in addition to the aforementioned oval, circular or polygonal outline, the indicia-bearing member can resemble a storybook figure, an animal, a mythological figure or a human or animal head.

The novel features which are considered as characteristic of the invention are set forth in particular in the appended claims. The improved toothbrush itself, however, both as to its construction and the mode of suspending and/or exhibiting the same, together with additional features and advantages thereof, will be best understood upon perusal of the following detailed description of certain specific embodiments with reference to the accompanying drawing.

BRIEF DESCRIPTION OF THE DRAWING

FIG. 5 is a plan view of an additional toothbrush in which the indicia-bearing member has an oval outline;

FIG. 6 is a plan view of a further toothbrush in which the indicia-bearing member has a polygonal outline;

FIG. 7 is a plan view of yet another toothbrush in which the indicia-bearing member resembles a storybook figure;

FIG. 8 is a plan view of one more toothbrush in which the indicia-bearing member resembles an animal;

FIG. 9 is a plan view of still a further toothbrush in which the indicia-bearing member resembles a mythological figure; and FIG. 10 is a plan view of an additional toothbrush in which the indicia-bearing member resembles a human head.

DESCRIPTION OF THE PREFERRED EMBODIMENTS

Figure 1:
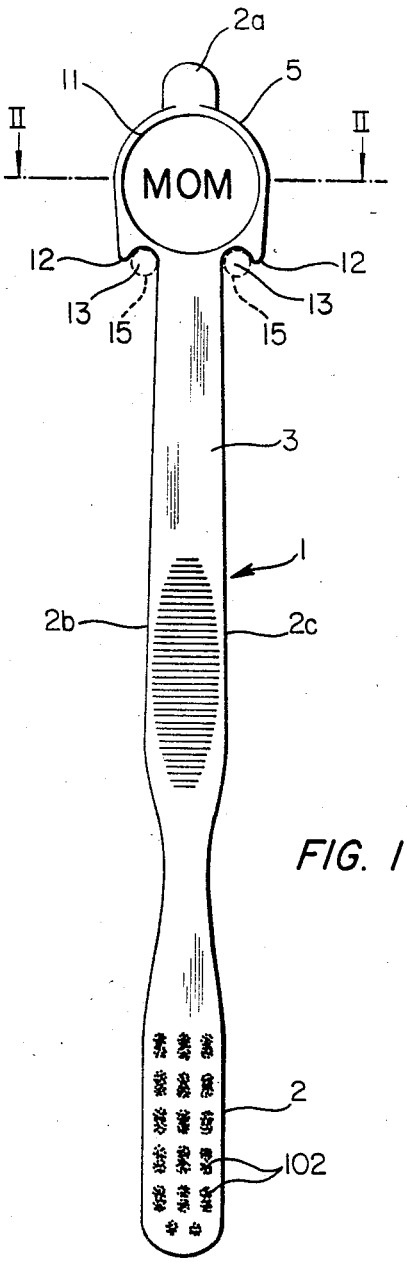
FIG. 1 is a plan view of a toothbrush which embodies one form of the invention and wherein the indicia-bearing member is a round disc which is adjacent to the second end portion of the handle.
Figure 2:
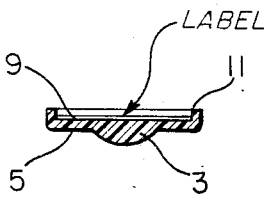
FIG. 2 is a transverse sectional view as seen in the direction of arrows from the line II—II of FIG. 1.

Referring first to FIGS. 1 and 2, there is shown a toothbrush which comprises an elongated slender handle 1 having a first end portion 2 provided with tufts of bristles 102 which are embedded therein and extend from one of its major surfaces toward the observer of FIG. 1. A second or major portion 3 of the handle 1 includes a second end portion 2*a*; this end portion is outwardly adjacent to a novel indicia-bearing member 5 which resembles a round disc and extends laterally beyond both longitudinal marginal portions 2*b*, 2*c* of the portion 3. The member 5 has an indicia-bearing surface 9 which is surrounded by a raised border or rim 11. The surface 9 which is shown in FIG. 2 is flat; however, it is equally possible to provide the member 5 with a convex or concave indicia-bearing surface. The indicia can be carried by an adhesive-coated label (denoted in FIG. 2 by a legend) which overlies and adheres to the surface 9. The label of FIGS. 1 and 2 carries the letters "MOM". The application of indicia to a label rather than directly to the surface 9 of the member 5 is desirable to the manufacturer and particularly to the merchant because, if the owner of a store notes that a certain type of brush (e.g., those to be purchased for or by an uncle or aunt) does not sell well, the original label can be concealed behind a freshly applied label bearing a different inscription or symbol which has been found to be more popular. The extent to which the member 5 extends laterally beyond the one and/or the other marginal portion 2*b*, 2*c* of the handle 1 depends on the preference of the manufacturer, on the configuration or outline of the member 5 and on the amount of information which is to be exhibited thereby. For example, the width of the member 5 (as considered at right angles to the longitudinal direction of the handle 1) can equal or approximate twice the width of the major portion 3. If the width of the major portion 3 does not exceed the width of the corresponding portion of the handle of a conventional toothbrush, the member 5 preferably extends well beyond at least one of the marginal portions. The purpose of the raised border 11 is to protect the label or the information which might be applied directly to the surface 9. Another purpose of the border 11 is to ensure that the outermost label of a stack of superimposed labels will not extend outwardly beyond the rim of such border and is therefore less likely to be accidentally peeled off or damaged.

FIG. 1 further shows that the indicia-bearing member 5 comprises means for facilitating suspension of the handle 1 in a store or at home. Such suspension facilitating means comprises two substantially hook-shaped projections 12 which are spaced apart from the neighboring marginal portions 2*b*, 2*c* by relatively shallow sockets 13. For example, the toothbrush of FIG. 1 can be suspended on a carrier which is provided with pairs of parallel wires 15 (indicated by broken lines) providing room for insertion of the handle 1 in such a way that the bristles 102 are located at the lower end of the handle 1 and the wires 15 enter the two sockets 13. Thus, in the embodiment of FIG. 1, the suspension facilitating means 12, 13 face the bristles 102.

FIG. 2 shows that the disc-shaped member 5 can be disposed at one side of the remaining part of the major portion 3 of the handle 1, preferably at that side of the handle from which the bristles 102 extend. The rather pronounced transition between the rear side of the member 5 and the major portion 3 of the handle 1 can be replaced with a more gradual transition or with an even more pronounced transition. This depends on the desired configuration of the handle and on the desired overall appearance of the toothbrush.

Figure 3:
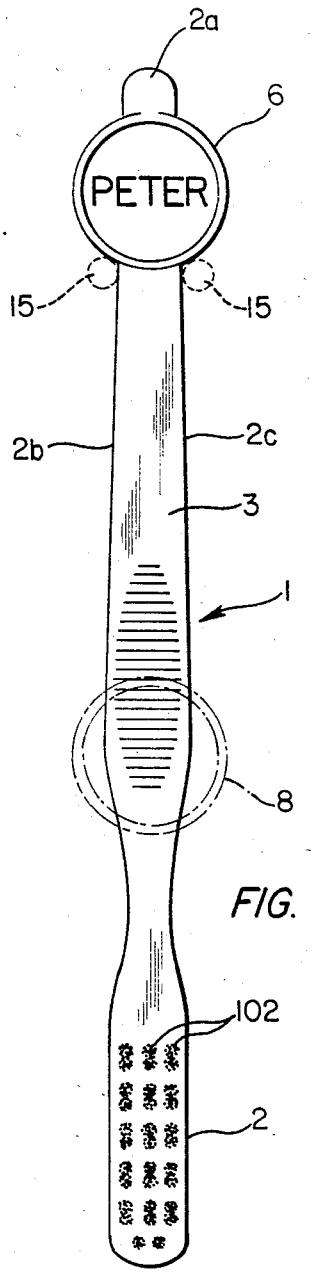
FIG. 3 is a plan view of a modified toothbrush, another position of the indicia-bearing member being indicated by phantom lines.

FIG. 3 shows a modified toothbrush wherein the indicia-bearing member 6 is adjacent to the second end portion 2*a* of the handle 1. The member 6 is preferably integral with the handle 1, the same as the member 5 of FIGS. 1 and 2. As can be seen in FIG. 3, the member 6 does not have any pronounced suspension facilitating means.

A different position for the indicia-bearing member is shown in FIG. 3 by phantom lines, as at 8. This member is integral with the major portion 3 of the handle 1 at a location which is nearer to the bristles 102 than to the end portion 2*a*. If the member 8 has any suspension facilitating means in the form of hooks or the like, such suspension facilitating means preferably face toward the end portion 2*a*, i.e., away from the bristles 102, so that the heavier part of the handle 1 is located at a level below the member 8.

The toothbrush of FIG. 3 can also be suspended between two horizontal or substantially horizontal wires 15 whose mutual spacing is only slightly greater than or equal to the distance between the marginal portions 2*b*, 2*c* but less than the diameter of the disc-shaped member 6 or 8. It has been found that even a disc-shaped indicia-bearing member can safely support the improved toothbrush on a stand in a store, commissary or an analogous institution.

Figure 4:
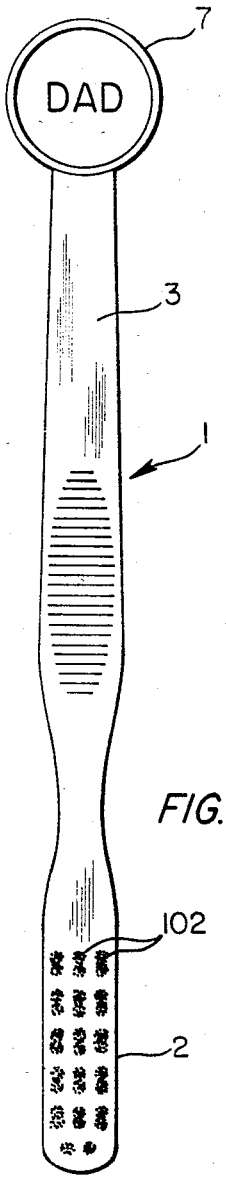
FIG. 4 is a plan view of still another toothbrush wherein the indicia-bearing member constitutes the second end portion of the handle.

The toothbrush of FIG. 4 deviates from the previously described toothbrushes in that the disc-shaped indicia-bearing member 7 is an integral part of the major portion 3 and constitutes that end portion of the handle 1 which is remote from the bristles 102. The manner in which the handles 1 can be mass-produced from a synthetic plastic or other suitable material and/or the manner of embedding the bristles 102 in the respective end portion 2 of the handle forms no part of the present invention.

The configuration of the improved toothbrush departs drastically from the configuration of conventional toothbrushes, even if such conventional toothbrushes also bear some indicia, e.g., in a manner as disclosed in the aforediscussed British patent. Moreover, the application of suitable indicia to the member 5, 6, 7 or 8 enhances the sales appeal of the toothbrush because it renders it a gift of a personal nature which can be presented to a relative, friend or other person on practically any occasion. For example, children can purchase the improved toothbrush as a relatively inexpensive gift for their parents or siblings.

An important advantage of the improved toothbrush is that the member 5, 6, 7 or 8 offers a relatively large area (surface 9 in FIG. 2) for the application of indicia in the form of letters, numerals and/or other information, e.g., a combination of colors, designs of flowers, names of localities or countries, signs of the zodiac and/or others. Moreover, the eye-pleasing appearance of the article can be enhanced by the application of different colors and/or by imparting to the indicia-bearing member a particular configuration (e.g., an oval outline as in FIG. 5, a polygonal outline as in FIG. 6, the outline of a storybook figure as in FIG. 7, the outline of an animal or animal head as in FIG. 8, the outline of a mthological figure as in FIG. 9, the outline of a human head as in FIG. 10, and/or others).

Another important advantage of the improved toothbrush is the versatility of its indicia-bearing member. Thus, in addition to facilitating ready identification among several toothbrushes, the indicia-bearing member also enhances the sales appeal of the toothbrush and facilitates more convenient suspension in or on very simple supports, e.g., the aforementioned support with pairs of parallel wires 15 or cords which can be resorted to irrespective of whether or not the indicia-bearing member is provided with specially designed (e.g., hook-shaped) suspension facilitating means. Analogous supports can be used for the improved toothbrush in a bathroom or in another room of a home. Adequate suspension or retention of the toothbrush in upright position reduces the likelihood of contamination and contributes to longer useful life of the bristles as well as to rapid drying. Still further, the toothbrush need not be stored in a cup so that the latter can be used by other persons using the bathroom.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A toothbrush comprising a handle including an end portion and an elongated substantially plane second portion having a pair of longitudinally extending marginal portions; bristles anchored in and extending from said end portion; a substantially disc-shaped indicia-bearing member provided on and generally coplanar with said second portion and extending laterally beyond at least one of said marginal portions; and means for facilitating suspension of the toothbrush in such orientation that said end portion is disposed at the lower end of said handle, including a discrete hook in the region of each of said marginal portions, said hooks defining sockets which are open toward said end portion and each of which can receive a wire- rod- or cord-like support for the toothbrush so that the latter can be suspended without tilting or turning.

2. The toothbrush of claim 1, wherein said member has a relatively large indicia-bearing surface.

3. The toothbrush of claim 1, wherein said member has a substantially circular outline.

4. The toothbrush of claim 1, wherein said handle has a second end portion forming part of said second portion and constituting said indicia-bearing member.

5. The toothbrush of claim 1, wherein said handle has a second end portion forming part of said second portion, said member being adjacent to said second end portion.

6. The toothbrush of claim 1, wherein said handle includes a second end portion forming part of said second portion and said member is remote from said second end portion.

7. The toothbrush of claim 9, wherein said member is nearer to said bristles than to said second end portion.

8. The toothbrush of claim 1, wherein said member has an indicia-bearing surface and a raised border surrounding at least a portion of said surface.

9. The toothbrush of claim 8, further comprising an indicia-bearing label adhering to said surface.

10. The toothbrush of claim 1, wherein said indicia-bearing member is an integral part of said handle.

* * * * *

UNITED STATES PATENT AND TRADEMARK OFFICE

CERTIFICATE OF CORRECTION

PATENT NO. : 4,589,159

DATED : May 20, 1986

INVENTOR(S) : Adolf STREIBEL

It is certified that error appears in the above-identified patent and that said Letters Patent are hereby corrected as shown below:

Col. 2, lines 60-68, should be deleted.
Col. 3, lines 1- 6, should be deleted.
Col. 5, lines 2- 7, "(e.g., an oval outline as in FIG. 5, a polygonal outline as in FIG. 6, the outline of a storybook figure as in FIG. 7, the outline of an animal or animal head as in FIG. 8, the outline of a mthological figure as in FIG. 9, the outline of a human head as in FIG. 10, and/or others)." should be deleted and the following inserted: --(e.g., the outline of a human or animal head, a mythological figure, a storybook figure, an animal and/or others).--.

Signed and Sealed this

Twenty-eighth Day of October, 1986

[SEAL]

*Attest:*

DONALD J. QUIGG

*Attesting Officer*

*Commissioner of Patents and Trademarks*